US006006449A

United States Patent [19]

Orlowski et al.

[11] Patent Number: 6,006,449

[45] Date of Patent: Dec. 28, 1999

[54] FOOTWEAR HAVING SPRING ASSEMBLIES IN THE SOLES THEREOF

[75] Inventors: Henry Orlowski; G. Paul Fletter, both of Coldwater; Alton L. Neal, II, Sherwood, all of Mich.

[73] Assignee: Precision Products Group, Inc., Rockford, Ill.

[21] Appl. No.: 09/015,712

[22] Filed: Jan. 29, 1998

[51] Int. Cl.[6] ..... A43B 13/28; A43B 21/30

[52] U.S. Cl. ..... 36/27; 36/38

[58] Field of Search ..... 36/27, 28, 37, 36/38, 7.8

[56] References Cited

U.S. PATENT DOCUMENTS

| | | | |
|---|---|---|---|
| 1,469,920 | 10/1923 | Dutchak | 36/38 |
| 1,675,256 | 6/1928 | Crosthwalt | 36/38 |
| 1,942,312 | 1/1934 | Tutoky | 36/38 |
| 2,535,102 | 12/1950 | Taylor | 36/38 |
| 2,669,038 | 2/1954 | De Werth | 36/38 |
| 4,592,153 | 6/1986 | Jacinto | 36/38 |
| 4,638,575 | 1/1987 | Illustrato | 36/38 |
| 4,715,130 | 12/1987 | Scatena | 36/27 |
| 4,815,221 | 3/1989 | Diaz | 36/27 |
| 4,843,737 | 7/1989 | Vorderer | 36/38 |
| 5,068,981 | 12/1991 | Jung | 36/3 R |
| 5,138,776 | 8/1992 | Levin | 36/38 |
| 5,224,278 | 7/1993 | Jeon | 36/29 |
| 5,369,896 | 12/1994 | Frachey et al. | 36/28 X |
| 5,502,901 | 4/1996 | Brown | 36/28 |
| 5,513,448 | 5/1996 | Lyons | 36/28 |
| 5,528,842 | 6/1996 | Ricci et al. | 36/27 |
| 5,544,431 | 8/1996 | Dixon | 36/38 |
| 5,560,126 | 10/1996 | Meschan et al. | 36/42 |
| 5,595,002 | 1/1997 | Slepian et al. | 36/27 |
| 5,649,374 | 7/1997 | Chou | 36/27 |
| 5,651,196 | 7/1997 | Hsieh | 36/27 |
| 5,671,552 | 9/1997 | Pettibone et al. | 36/27 |
| 5,743,028 | 4/1998 | Lombardino | 36/27 |
| 5,832,629 | 11/1998 | Wen | 36/27 |

*Primary Examiner*—B. Dayoan
*Attorney, Agent, or Firm*—Harness, Dickey & Pierce, P.L.C.

[57] ABSTRACT

A shoe having a preassembled spring assembly incorporated into the sole thereof is provided. The spring assembly includes a pair of plates having a plurality of apertures formed therein. The pair of plates define an upper plate and a lower plate in which the apertures formed in the upper and lower plates are axially aligned when the upper plate is disposed directly above the lower plate. A plurality of spring members are disposed between the upper and lower plates. The spring members are axially aligned with the plurality of apertures. A mechanism for retaining the spring members between the upper and lower plates is also provided. The mechanism for retaining is designed for retaining the upper and lower plates at a predetermined distance.

25 Claims, 5 Drawing Sheets

FOOTWEAR HAVING SPRING ASSEMBLIES IN THE SOLES THEREOF

BACKGROUND OF THE INVENTION

1. Technical Field

The present invention relates generally to footwear and more particularly to athletic-type shoes having a spring assembly module integrated into the sole and/or heel of a shoe for cushioning the impact forces placed thereon.

2. Discussion

As is generally known in the art, footwear is currently comprised of a sole made of foam, plastic, rubber, or leather in various forms and densities. A manufactured upper made of nylon fabric, plastic or leather in various combinations is then attached to the sole. As the wearer of the shoe walks, jogs, or runs in the shoe, the harder plastics and foams forming the sole give the shoe shape and support while the softer foams give comfort and absorb the shock of the foot pounding onto the hard surfaces of a court, street, or sidewalk. As the foam absorbs the impact energy from the walking or running forces, it converts some of that energy into shape deformation. Most of the remaining energy is converted into heat. Thus, the temperature inside the shoe can easily exceed 130° F. As the foot gets hot, the body tries to manage the excess heat and the foot sweats. The sweat contains moisture, salt, ammonia and other chemicals that, together with the heat, attack and degrade the plastics, foams and rubber components of the shoe.

Additionally, the foam takes an increased set with more use resulting in less effectiveness in absorbing the impact forces. It is commonly recommended that shoes be used every other day to give the shoes a chance to dry out and for the foam to regain its shape, though the shape will never return entirely. Shoe manufacturers also recognize that the shoe's capability to absorb shock can be seriously degraded after only 100 miles of hard running.

In an attempt to overcome this problem, air bags or air bladders of various shapes have been used with some success to absorb shock and provide additional comfort. The currently used air bags are able to return more energy to the wearer through a higher rebound rate thereby converting less energy to heat. However, these air bags are also made of plastic which is susceptible to degradation problems resulting from the heat and chemical attack of the operating environment. As they degrade, air bags lose air and their strength. Air bags also have less stability as the air "squirts" away from the impact load requiring additional means of support to be utilized by designers to provide more stability to the shoe.

Accordingly, it is desirable to provide a device for absorbing the impact forces imparted on footwear which is lightweight and less sensitive to the destructive effects of heat and chemicals within the operating environment. It is further desirable to provide an impact absorbing device which does not break down structurally with extended use, and is further capable of returning a higher level of energy to the wearer during a walking or running activity.

SUMMARY OF THE INVENTION

According to the present invention, preassembled spring assemblies are inserted into cavities formed in the sole and/or heel of the shoe. Each spring assembly includes one or more coil springs that are mounted at opposite ends to a pair of plates. Each of the plates is formed with a corresponding plurality of spring supports, which may, for example, take the form of upstanding tabs or posts that are punched from or formed on the plate and are adapted to tightly engage the end coils of the springs when the springs are press fit thereon. In one of the preferred embodiments, the spring assembly is precompressed from its normal free-state height by various means, so that the spring assembly only responds to compressive loads above a predetermined minimum level. Precompression of the spring assembly also serves to minimize the space taken up by the spring assembly.

BRIEF DESCRIPTION OF THE DRAWINGS

The various advantages of the present invention will become apparent to one skilled in the art by reading the following specification and appended claims, and by referencing the following drawings in which:

DETAILED DESCRIPTION OF THE PREFERRED EMBODIMENTS

Figure 1:
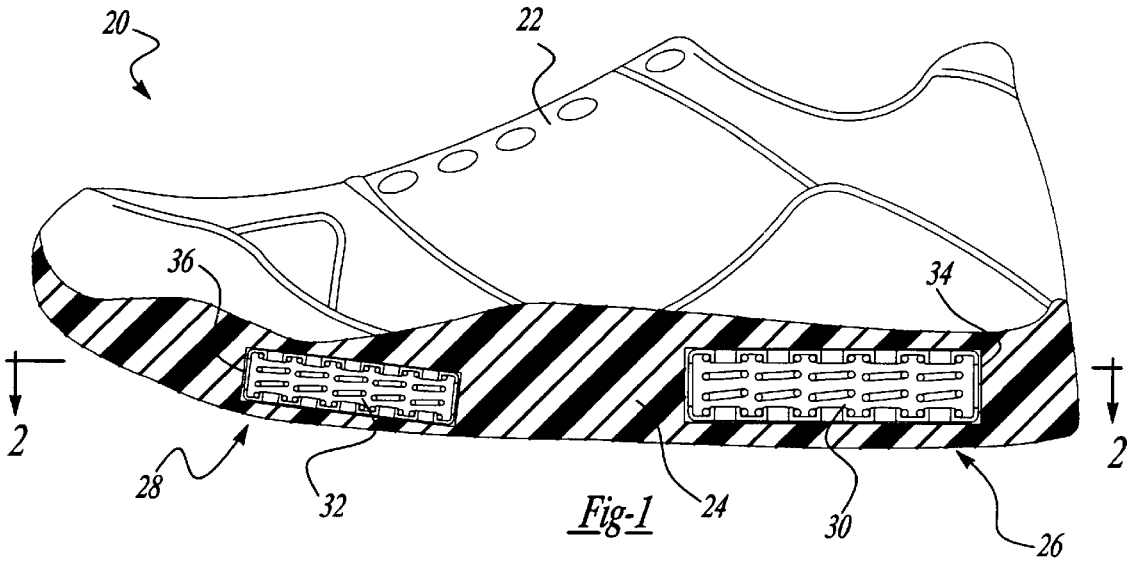
FIG. 1 is an elevational view of an exemplary shoe according to the present invention having the spring assemblies incorporated therein.

The present invention is generally directed to a shoe and in particular to an athletic-type shoe that has a spring assembly incorporated into the sole of the shoe for absorbing and returning the impact forces placed thereon. With reference to FIG. 1, an exemplary shoe 20 is shown. As disclosed, shoe 20 is an athletic or running style shoe. However, one skilled in the art will readily appreciate that the spring assembly associated with the present invention can be incorporated into a variety of shoes. Shoe 20 includes a manufactured upper 22, and preferably, an injection or overmolded sole 24. Sole 24 can be molded from a variety of materials, including plastic, foam, rubber or rubber compounds, and preferably includes a heel portion 26 and a forefoot portion 28. A spring assembly 30 according to the teachings of the present invention, is incorporated into heel portion 26. In a similar fashion, a second spring assembly 32 is also incorporated into the forefoot portion 28. It will be understood hereinafter and in the claims that reference to the "sole" of the shoe is intended to include not only the forefoot portion 28 and heel portion 26 of the shoe, but the entire bottom of the shoe 20.

Significantly, the spring assemblies used in the present invention are manufactured as separate subassemblies that are designed to be placed directly into the mold used to form the sole of the shoe. Alternatively, for shoes that are manufactured by adhering the sole to the upper part 22 such as by gluing, or where the sole is formed with multiple layers, cavities 34 and 36 may be formed into the sole or upper sole layer of the shoe and the spring assemblies 30 and 32 placed therein before the sole is attached to the upper part 22 or the bottom sole layer is added. Typically, however, during the shoe manufacturing process, the sole 24 is molded directly to the upper part 22 of the shoe. With this type of process, the spring assemblies used in the present invention can be positioned directly into the mold so that the spring assemblies are molded in place. Preferably, for this type of manufacturing process, the spring assemblies are placed in flexible bags, or the peripheries and apertures taped over, as described below, to prevent sole material from flowing between the plates 38 into the springs 40 during the molding process.

Figure 2:
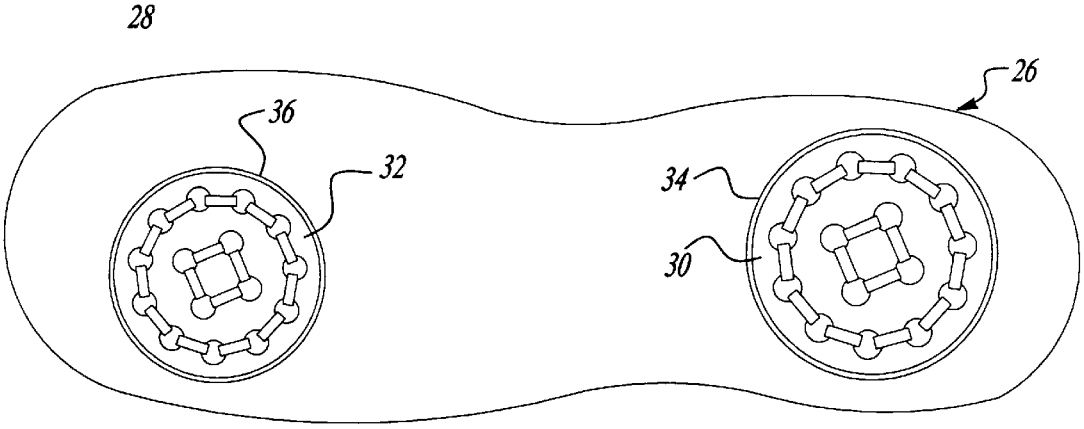
FIG. 2 is a cross-sectional view taken along line 2—2 of FIG. 1.

Referring to FIG. 2, the spring assembly 30 occupies a significant area of heel portion 26 due to the level of impact forces placed thereon. Preferably, a smaller spring assembly 32 is positioned within the forefoot portion 28 beneath the ball and forefoot of the wearer's foot. It should be understood that spring assemblies 30, 32 can be manufactured in a wide range of sizes and spring forces for accommodating all types of footwear and various sized individuals.

Figure 3:
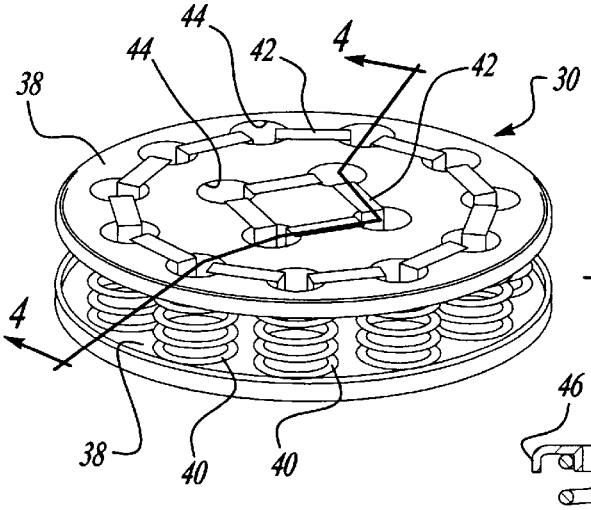
FIG. 3 is a perspective view of the spring assembly used in a preferred embodiment of the present invention.

Turning now to FIG. 3, spring assembly 30 according to a first preferred embodiment of the present invention is disclosed in further detail. More particularly, spring assembly 30 includes a pair of spring plates 38 which are preferably formed from sheet metal stock during a stamping process. Alternatively, spring plates 38 can be formed from a durable and relatively stiff plastic material such as glass filled nylon. As shown, spring plates 38 are positioned opposite one another and a plurality of helical springs 40 are secured therebetween. It is preferred that each spring plate 38 be identical so that when one of the plates is flipped and disposed directly above the other, the pair of plates remain mirror images of each other. It is also preferred that springs 40 are precompressed to a predetermined force constant which sets a threshold force level which must be exceeded before spring plates 38 can be compressed toward each other. Means for retaining spring plates 38 and springs 40 in this precompressed state are then provided. Significantly, it will be appreciated that spring assembly 30 forms a preassembled component which can then be used in the manufacturing of shoe 20.

Figure 4:
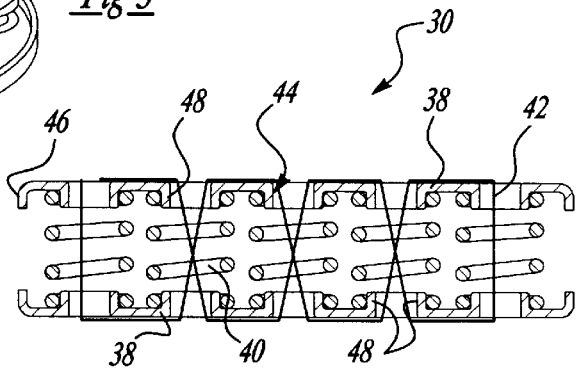
FIG. 4 is a partial sectional view of the spring assembly shown in FIG. 3.

As shown in FIGS. 3 and 4, this means for retaining is an aramid lacing or roving 42, such as Kevlar®, which is laced through a plurality of apertures 44 stamped within each spring plate 38. However, it should be understood that this means for retaining may be implemented in a variety of ways, several of which are described in further detail below. As shown, one or more pieces of roving 42 can be laced through apertures 44 with the respective ends being bonded together. Testing of this aramid roving 42 shows that spring assembly 30, precompressed to 300 lbs., can be cycled over 850,000 times with little of no wear or degradation showing on roving 42.

FIG. 4 discloses the details associated with spring assembly 30. As disclosed, each spring plate 38 includes a rolled edge or flange 46 about its circumference. Flange 46 provides a smooth outer edge for reducing friction between each spring plate 38 and the surrounding shoe material forming the sole 26 and 28. Additionally, flange 46 eliminates any sharp edge which could cause heel portion 26 or forefoot portion 28 to wear prematurely.

Each aperture 44 within spring plate 38 includes an annular flange 48 which provides several advantages. Apertures 44 and flanges 48 are then axially aligned between plates 38. More specifically, flange 48 provides a post for securely retaining each helical spring 40. FIG. 4 shows how the inside diameter of each spring 40 is press fitted over flange 48. This feature provides spring assembly 30 with structural integrity, by securing the ends of the springs 40 to the plates 38 and by eliminating any lateral motion of the springs between spring plates 38. Each flange 48 also provides a smooth or rounded surface which prevents roving 42 from wearing due to the concentration of forces at the transition edge between aperture 44 and flange 48.

Figure 5:
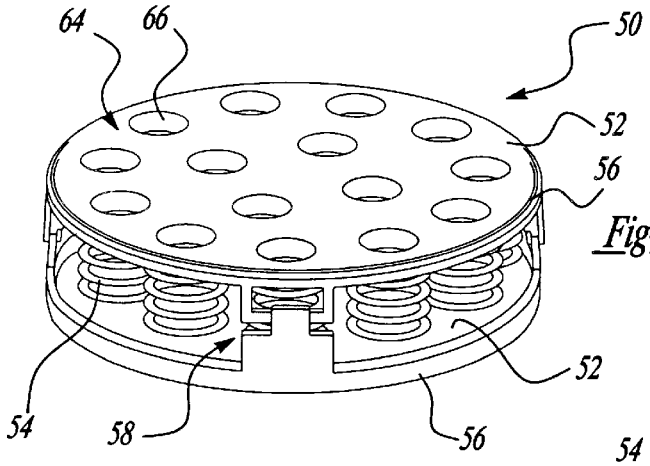
FIG. 5 is a perspective view of the spring assembly used in a second preferred embodiment of the present invention.
Figure 6:
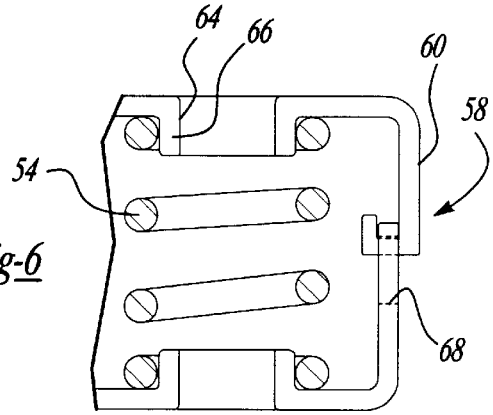
FIG. 6 a partial sectional view of the spring assembly shown in FIG. 5.
Figure 7:
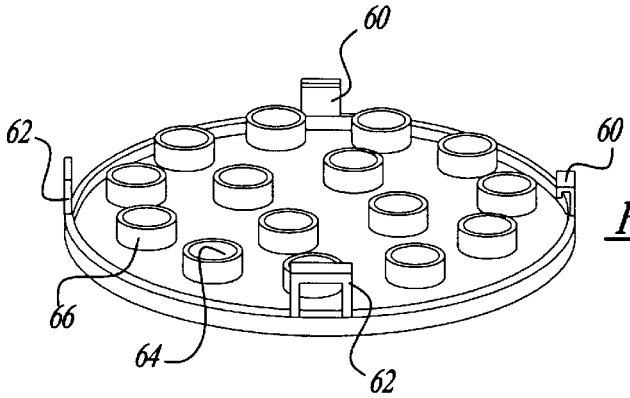
FIG. 7 is a perspective view of the spring plate according to the second preferred embodiment.

Referring now to FIG. 5, the spring assembly 50 according to a second preferred embodiment of the present invention is disclosed. Spring assembly 50 also includes a pair of spring plates 52 which are preferably formed from sheet metal stock during a stamping process. Spring plates 52 are positioned opposite one another as described above and a plurality of springs 54 are secured therebetween. Springs 54 are also preferably precompressed to a predetermined force constant. Means for retaining spring plates 52 and springs 54 into a precompressed subassembly are then provided. As shown in FIGS. 5 through 7, this means for retaining is a hook and loop arrangement 58 which is stamped into each spring plate 52. Accordingly, each spring plate 52 is substantially similar to each spring plate 38, except for the addition of two hooks 60 and two loops 62 at the outer circumference of each spring plate 52. A plurality of apertures 64 are also formed within each spring plate 52 such that an annular flange 66 is formed for receiving one end of each spring 54.

FIG. 6 discloses the details associated with spring assembly 50. As shown, each spring plate 52 also includes a rolled edge or flange 56 about its circumference. Each hook 60 and loop 62 then extends from flange 56. During assembly of the spring plates 52 and springs 54, spring plates 52 are placed opposite one another so that each hook 60 is aligned with a corresponding loop 62. Each hook 60 is then inserted into and engaged with each loop 62 to complete this means for retaining spring plates 52. The opposing forces between spring plates 52 caused by springs 54 serve to maintain hook and loop arrangement 58 in the engaged position. As shown, the J-shaped end of each hook 60 is deep enough to allow loop 62 to move vertically therein approximately one-quarter inch without completely disengaging hook and loop arrangement 58. Accordingly, this system provides an integral means for retaining which further allows spring plates 52 to be compressed toward each other.

Figure 8:
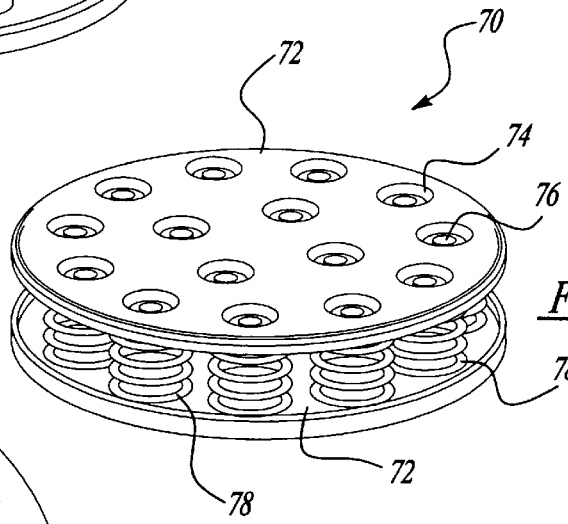
FIG. 8 is a perspective view of the spring assembly according to a third preferred embodiment of the present invention.
Figure 9:
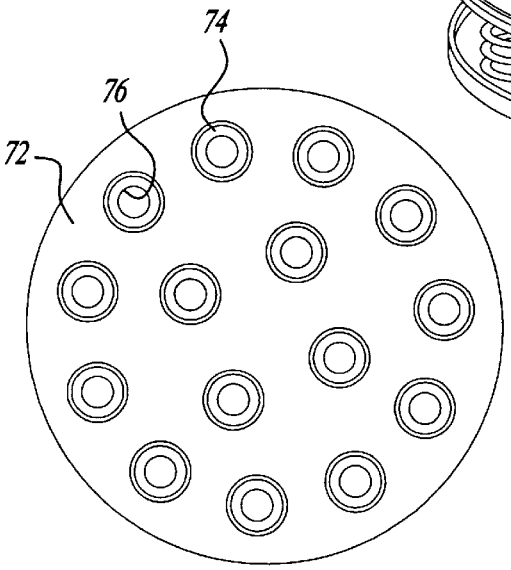
FIG. 9 is a top plan view of the spring plate according to the third preferred embodiment.
Figure 10:
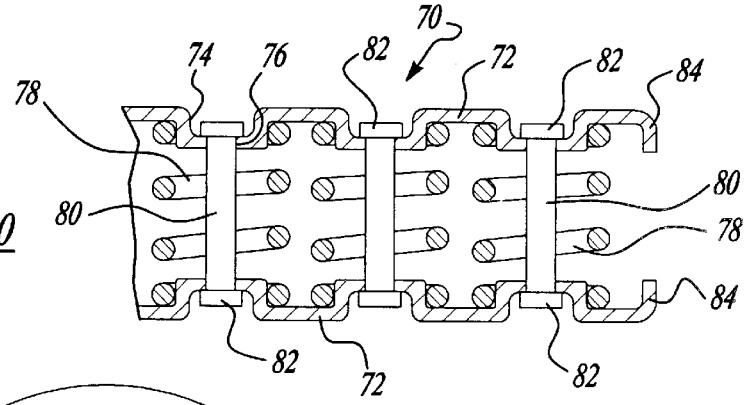
FIG. 10 is a partial sectional view of the spring assembly shown in FIG. 8.

With reference to FIG. 8, the spring assembly 70 according to a third preferred embodiment of the invention is shown. According to this embodiment, spring assembly 70 is comprised of a pair of spring plates 72 which are also preferably formed during a stamping process. Each spring plate 72 includes a plurality of dimples 74 stamped therein. However, if spring plate 72 is formed from a plastic material as described above, dimples 74 would preferably be molded therein. The center of each dimple 74 has a hole 76 formed therethrough. Spring plates 72 are positioned opposite one another and a plurality of springs 78 are secured therebetween. Springs 78 are then precompressed or preloaded to a predetermined force constant as described above. Means for retaining spring plates 72 and springs 78 as an integrated subassembly are then provided. As shown in FIG. 10, this means for retaining comprises a metal post or rivet 80 which extends between recesses or dimples 74 and through the holes 76 formed therein. The ends 82 of each rivet 80 are then staked or flanged for permanently securing spring plates 72 together at a predetermined height less than the free-state height of the springs. As disclosed, each rivet 80 has a constant diameter along its axial length which allows spring plates 72 to move along each rivet 80 as the plates 72 are compressed toward each other.

As will be appreciated, each spring plate 72 is identical, which significantly reduces the costs of the associated tooling. Accordingly, when the upper spring plate is flipped and disposed directly above the lower spring plate, spring plates 72 form mirror images of each other. Moreover, this arrangement provides axial alignment between upper and lower dimples 74 and holes 76, and a corresponding axial alignment for helical springs 78.

FIG. 10 also discloses the details associated with spring assembly 70. As shown, each spring plate 72 also includes a rolled edge or flange 84 about its circumference. Flange 84 provides a smooth outer edge for reducing friction between spring plate 72 and the material forming heel 26, and eliminates any sharp edge which could cause heel portion 26 or forefoot portion 28 to wear prematurely.

Figure 11:
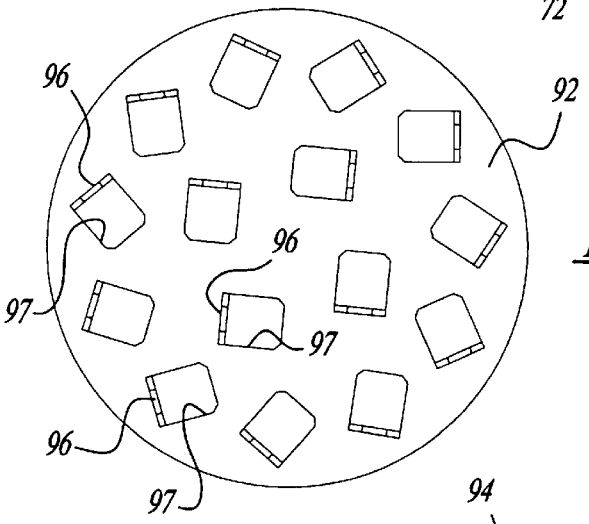
FIG. 11 is a top plan view of the spring plate according to a fourth preferred embodiment of the present invention.
Figure 12:
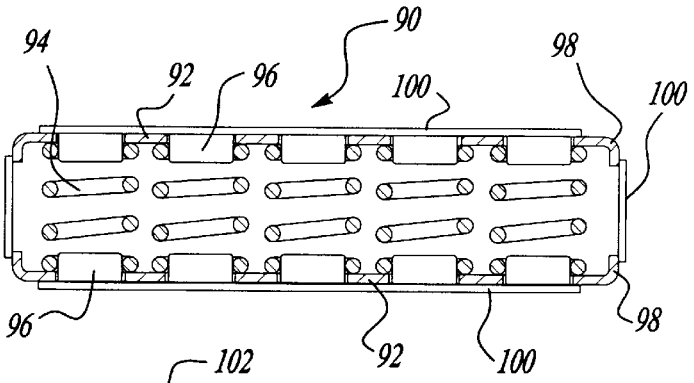
FIG. 12 is a partial sectional view of the spring assembly according to the fourth preferred embodiment.

Turning now to FIGS. 11 and 12, the spring assembly 90 according to a fourth preferred embodiment of the present invention is disclosed. More particularly, spring assembly 90 includes a pair of spring plates 92 which are also formed from sheet metal stock during a stamping process. As shown in FIG. 12, spring plates 92 are positioned opposite one another and a plurality of springs 94 are secured therebetween. In this embodiment, springs 94 are maintained at their free state height because there is no mechanism for precompressing spring plates 92. However, apertures 97 will allow a roving similar to that described above to be used for preloading springs 94 to a predetermined force constant, if such an arrangement is desired.

In either configuration, means for retaining spring plates 92 and springs 94 as a subassembly are provided. As shown in FIGS. 11 and 12, this means for retaining comprises a plurality of metal flanges 96 which extend perpendicular to the surface of spring plates 92. The voids which result in the surface of each spring plate 92 after forming flanges 96 produce apertures 97. Metal flanges or tabs 96 are preferably stamped within each spring plate 92 and have a width which is slightly larger than the inside diameter of each spring 94. This allows the end of each spring 94 to be press fit and securely retained on its associated flange 96.

FIG. 12 further discloses the details associated with spring assembly 90. As shown, each spring plate 92 includes a rolled edge or flange 98 about its circumference. Flange 98 provides a smooth outer edge for reducing friction between spring plate 92 and the material forming heel 26, as well as eliminating any sharp edge which could cause sole 24 or heel 26 to wear prematurely. FIG. 12 also shows the completed assembly 90 of spring plates 92 and springs 94, where it can be seen that springs 94 are securely retained between flanges 96. This technique prevents the unwanted separation of spring plates 92 while also eliminating the need for an additional means for retaining. Accordingly, spring assembly 90 (which as shown is not preloaded) is ideally suited for casual or walking style shoes in which it is desirable to provide a more cushioned spring response. To prevent foreign material from entering spring assembly 90 particularly during the shoe molding process, tape 100 can be applied over the apertures 97 and wrapped around the circumference of spring assembly 90 and adhered to flanges 98 for sealing the outside edges.

Figure 13:
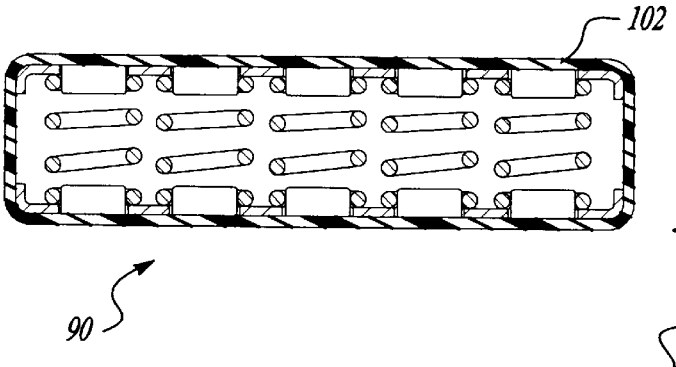
FIG. 13 is a partial sectional view of the spring assembly encapsulated within an outer packaging material.

Turning now to FIG. 13, spring assembly 90 is shown in an alternate configuration. As shown, each spring assembly 90 can also be encapsulated within a pliable casing 102 which also prevents foreign material from entering spring assembly 90 during the shoe molding process. Suitable materials for casing 102 include, but are not limited to, various pliable plastic materials, or an aramid based material such as Kevlar®.

Figure 14:
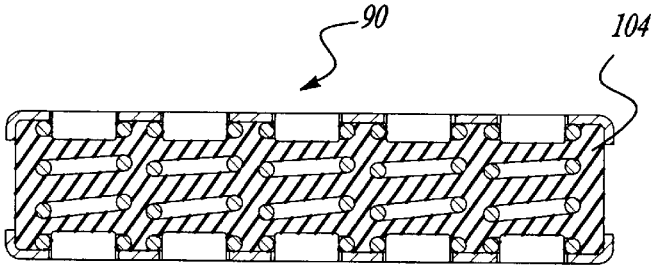
FIG. 14 is a partial sectional view of the spring assembly showing the interior filled with a compressible material.
Figure 15:
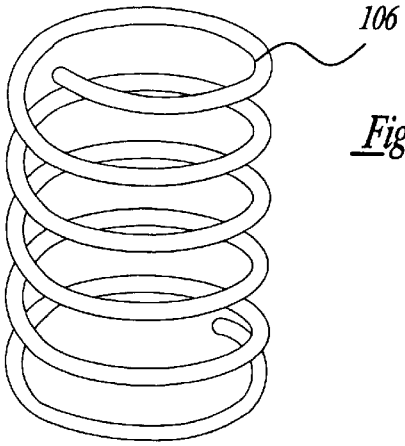
FIG. 15 is a perspective view of a linear helical spring suitable for use with the spring assembly of the present invention.
Figure 16:
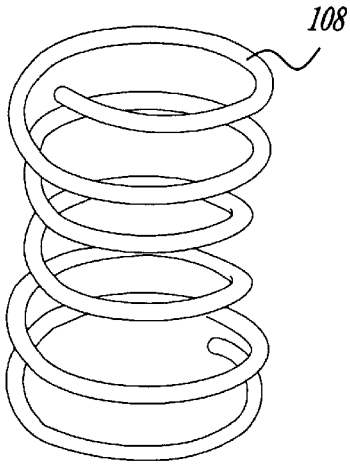
FIG. 16 is a perspective of a progressively wound or non-linear helical spring, also suitable for use with the spring assembly of the present invention.
Figure 17:
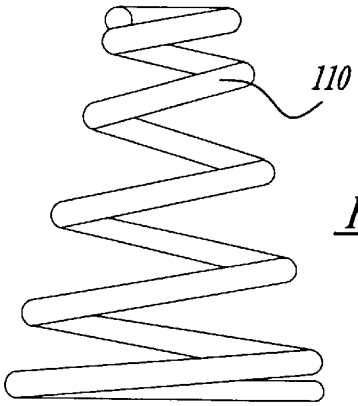
FIG. 17 is a perspective view of a conical spring, also suitable for use with the spring assembly of the present invention.

In yet another alternative arrangement represented in FIG. 14, spring assembly 90, or any of the other spring assemblies 30, 50, 70, according to the present invention, can be filled with a compressible material such as close-celled foam 104 to keep sole material from migrating into the spring assembly during the shoe molding process. The density of foam 104 can also be specifically chosen for selectively adjusting the compression characteristics of the spring assembly. FIG. 15 discloses a linear helical spring 106 which is the preferred type of spring for use with spring assemblies 30, 50, 70, 90 of the present invention. However, as shown in FIGS. 16 and 17, a non-linear helical spring 108 or conical spring 110 may also be employed for providing a variable or non-linear spring compression force within each spring assembly 30, 50, 70, 90. Additionally, a combination of linear springs 106 and non-linear springs 108, 110 can also be used.

Figure 18A:
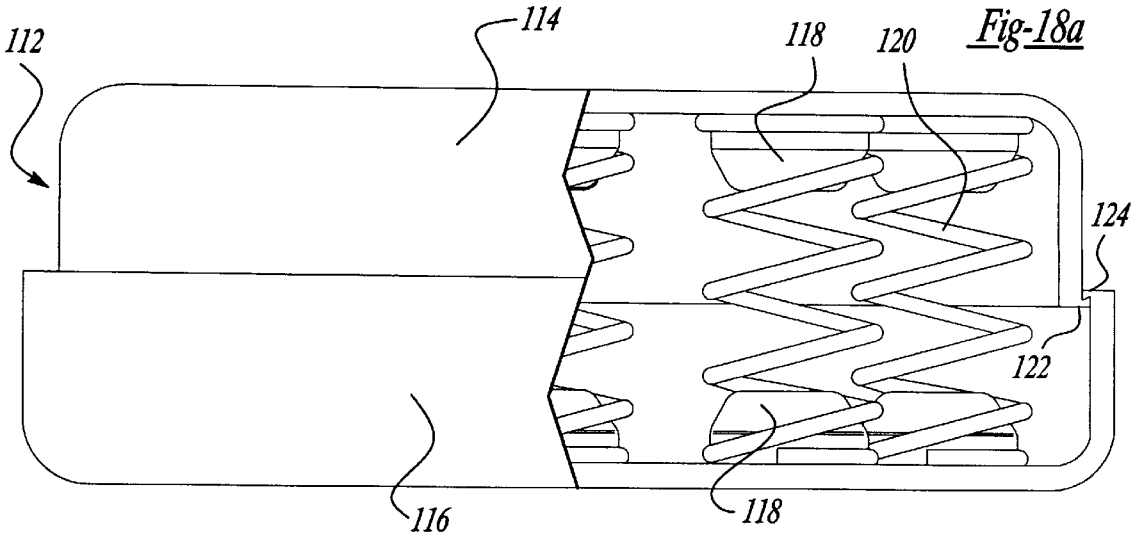
FIG. 18*a* is a partial cutaway view of a fifth preferred embodiment of a spring assembly for use in the present invention.
Figure 18B:
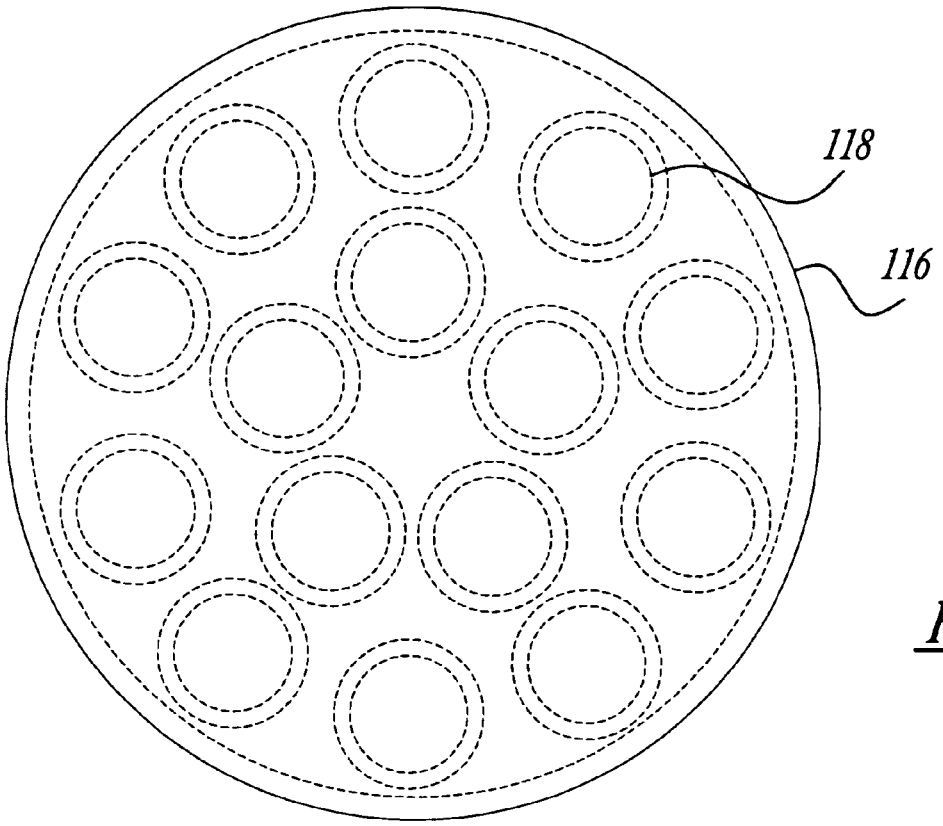
FIG. 18*b* is a plan view of the lower shell half of the spring assembly shown in FIG. 18*a*.

Turning now to FIGS. 18*a* and 18*b*, a further embodiment of the spring assembly for use in the present invention is shown. The spring assembly 112 in this embodiment comprises upper and lower cup-shaped shell halves 114 and 116 that are preferably molded of a hard plastic material, such as nylon. Each of the shell halves 114 and 116 has a plurality of posts 118 that are integrally formed on its bottom interior surface. The posts 118 are formed at corresponding locations on each shell half 114 and 116 so that when the shell halves are formed, the posts 118 on shell half 114 are aligned with the posts 118 on shell half 116. A corresponding plurality of compression springs 120 are snap-fit over the respectively opposed posts 118 on the shell halves 114 and 116, as shown, so that the shell halves 114 and 116 are joined together to form a unitary assembly.

One of the shell halves, in this case upper half 114, is smaller in diameter than the other shell half 116 so that the upper shell half 114 can fit within the lower shell half 116 as the springs are compressed. Additionally, it will be noted in the preferred embodiment, the upper shell half 114 is formed with an outwardly projecting lip or ridge 122 around its periphery and the lower shell half 116 is formed with an inwardly projecting lip or ridge 124 around its periphery. The complementary ridges 122 and 124 are designed to permit the two shell halves 114 and 116 to be snapped together with sufficient holding force to pre-compress the plurality of springs 120 to a prescribed preload condition, such as 100 lbs. Importantly, the ridges 122 and 124 are formed so that the upper shell half 114 can move freely into the lower shell half 116 when the spring assembly 112 is compressed. Additionally, it will be appreciated that with the snap fit of the two shell halves 114 and 116, it is not necessary for the springs 120 to also provide a secure snap fit onto the posts 118 to ensure a unitary spring assembly 112.

One of the unique features of the present invention is that springs 40 disposed between spring plates 38 may be precompressed to a predetermined force constant. This feature reduces the package size of the spring assembly and provides the spring assembly 30 with a threshold level of force which must be exceeded before spring plates 38 will be compressed toward each other. The predetermined force constant is determined by the type of activity which is expected for the footwear. In the case of running shoes for an average sized person, spring assembly 30 may be precompressed to approximately 200 pounds, and will typically become fully compressed at 500 pounds. For example, during running activity, the precompressed spring assembly 30 and sole 26 feels relatively rigid (except for the compressive characteristics of the sole material itself) until loading exceeds the 200 pound preload limit. These preload thresholds can be changed as required for the particular application. It should also be noted that when running, the typical runner imparts two to three times their weight on impact to their footwear. Therefore, a 170 pound male experiences approximately 350–500 pounds of force on initial impact. If these shoes do not have a preloaded spring assembly 30, they will provide more cushion on impact, but may provide less of a "controlled" feel. Accordingly, for a running shoe application, it is preferred that a precompressed spring assembly 30 be incorporated into shoe 20.

Alternatively, if springs 40 are not precompressed, this free-state embodiment can handle from approximately 0–600 pounds of force. Accordingly, the free-state spring assembly will provide more spring-back effect for a more cushioned feel which is better suited for casual or walking type footwear. In comparison, the precompressed spring assembly will provide a more "controlled" feel with a less cushioned effect for handling larger impact force loads.

The foregoing discussion discloses and describes exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A show having an upper portion and a sole member secured to said upper portion, and a unitary spring assembly incorporated into the sole member of said shoe, said spring assembly comprising:

a pair of plates each having a plurality of supports formed thereon, said pair of plates forming an upper plate and a lower plate wherein the plurality of supports formed on the upper and lower plates are axially aligned;

a plurality of spring members disposed between the upper and lower plates, the ends of the spring members engaging the plurality of supports on each plate; and means for retaining the spring members on said supports between the upper and lower plates such that the upper and lower plates are retained in a position which precompresses the plurality of spring members to about 200 pounds.

2. The shoe of claim 1 wherein the means for retaining positions the upper and lower plates in a substantially parallel arrangement.

3. The shoe of claim 1 wherein the means for retaining defines a maximum separation distance between the upper and lower plates.

4. The shoe of claim 1 wherein the upper plate and lower plates include a flange about their periphery.

5. The shoe of claim 1 wherein the means for retaining is a rigid fastener extending between the pair of plates.

6. The shoe of claim 1 wherein a pliable material surrounds and encases the spring assembly.

7. A shoe comprising:

an upper;

a sole member attached to the upper;

a preassembled spring assembly integrated within the sole member, the spring assembly including a pair of plates having a plurality of supports formed thereon, the pair of plates forming an upper plate and a lower plate wherein the plurality of supports formed on the upper and lower plates are axially aligned when the upper plate is disposed directly above the lower plate;

a plurality of spring members having end coils and disposed between the upper and lower plates, the end coils of the spring members being axially aligned with the plurality of supports;

a mechanism for retaining the spring members between the upper and lower plates; and a means for retaining the upper and lower plates at a predetermined distance which precompresses the plurality of spring members to about 200 pounds.

8. The shoe of claim 7 wherein the spring assembly is integrated into the sole member beneath the heel of a wearer's foot.

9. The shoe of claim 7 wherein at least one cylindrical chamber is formed in the sole member for receiving the spring assembly.

10. A shoe including a sole member for incorporating a preassembled spring assembly comprising:

a pair of plates having a plurality of supports formed therein, said pair of plates forming an upper plate and a lower plate wherein the plurality of supports formed in the upper and lower plates are axially aligned when the upper plate is disposed directly above the lower plate, said plates having an annular flange formed about the circumference;

a plurality of spring members disposed between the upper and lower plates, the spring members being axially aligned with the plurality of supports; and means for retaining the spring members between the upper and lower plates, the means for retaining positioning the upper and lower plates at a distance which precompresses to about 200 pounds the plurality of spring members disposed therebetween.

11. The spring assembly of claim 10 wherein the spring members disposed between the upper and lower plates are precompressed to a predetermined force constant.

12. The spring assembly of claim 10 wherein the means for retaining positions the upper and lower plates in a substantially parallel arrangement.

13. The spring assembly of claim 10 wherein the means for retaining defines a maximum separation distance between the upper and lower plates.

14. The spring assembly of claim 10 wherein the means for retaining allows the upper and lower plates to be moved toward each other as the plurality of spring members are compressed.

15. A shoe having an upper portion and a sole member secured to said upper portion, and a unitary spring assembly incorporated into the sole member of said shoe, said spring assembly comprising:

a pair of plates each having a plurality of supports formed thereon, said pair of plates forming an upper plate and a lower plate wherein the plurality of supports formed on the upper and lower plates are axially aligned, and wherein a plurality of apertures are formed in said upper and lower plates defining an annular flange;

a plurality of spring members disposed between the upper and lower plates, the ends of the spring members engaging the plurality of supports on each plate; and means for retaining the spring members on said supports between the upper and lower plates.

16. A shoe having an upper portion and a sole member secured to said upper portion, and a unitary spring assembly incorporated into the sole member of said shoe, said spring assembly comprising:

a pair of plates each having a plurality of supports formed thereon, said pair of plates forming an upper plate wherein the plurality of supports formed on the upper and lower plates are axially aligned and wherein a plurality of apertures are formed in said upper and lower plates;

a plurality of spring members disposed between the upper and lower plates, the ends of the spring members engaging the plurality of supports on each plate; and a lacing material which is laced through the plurality of apertures for retaining the spring members on said supports between the upper and lower plates for retaining the upper and lower plates at a predetermined distance.

17. The shoe of claim 16 wherein the lacing material is an aramid material which is laced through the plurality of apertures.

18. A shoe having an upper portion and a sole member secured to said upper portion, and a unitary spring assembly incorporated into the sole member of said shoe, said spring assembly comprising:

a pair of plates each having a plurality of supports formed thereon, said pair of plates forming an upper plate and a lower plate wherein the plurality of supports formed on the upper and lower plates are axially aligned;

a plurality of spring members disposed between the upper and lower plates, the ends of the spring members engaging the plurality of supports on each plate; and a hook and loop arrangement formed on the pair of plates for retaining the ring members on said supports between the upper and lower plates.

19. A shoe having an upper portion and a sole member secured to said upper portion, and a unitary spring assembly incorporated into the sole member of said shoe, said spring assembly comprising:

a pair of plates each having a plurality of supports formed thereon, said pair of plates forming an upper plate and a lower plate wherein the plurality of supports formed on the upper and lower plates are axially aligned, and wherein each plate includes a pair of hook members and a pair of loop members formed at the outer periphery thereof, the pair of hook members of each plate engaging the pair of loop members of each opposing plate;

a plurality of spring members disposed between the upper and lower plates, the ends of the spring members engaging the plurality of supports on each plate; and means for retaining the spring members on said supports between the upper and lower plates.

20. A shoe having an upper portion and a sole member secured to said upper portion, and a unitary spring assembly incorporated into the sole member of said shoe, said spring assembly comprising:

a pair of plates each having a plurality of supports formed thereon, said pair of plates forming an upper plate and a lower plate wherein the plurality of supports formed on the upper and lower plates are axially aligned;

a plurality of spring members disposed between the upper and lower plates, the ends of the spring members engaging the plurality of supports on each plate; and a plurality of flanges extending from an inside surface of the upper and lower plates, the flanges being operably coupled to the spring member for retaining the spring members on said supports between the upper and lower plates.

21. The shoe of claim 20 wherein each of the plurality of springs is press fit at each end thereof onto the flanges formed on the pair of plates.

22. A shoe having an upper portion and a sole member secured to said upper portion, and a unitary spring assembly incorporated into the sole member of said shoe, said spring assembly comprising:

a pair of plates each having a plurality of supports formed thereon, said pair of plates forming an upper plate and a lower plate wherein the plurality of supports formed on the upper and lower plates are axially aligned;

a plurality of spring members disposed between the upper and lower plates, the ends of the spring members engaging the plurality of supports on each plate;

means for retaining the spring members on said supports between the upper and lower plates; and a cellular foam material disposed between the upper and lower plates for surrounding the spring members.

23. The shoe of claim 22 wherein the cellular foam material is chosen to have a particular density for selecting the compression characteristics of the unitary spring assembly.

24. A shoe comprising:

an upper;

a sole member attached to the upper;

a first and second preassembled spring assembly integrated within the sole member beneath the heel and ball of a wearer's foot, each spring assembly including a pair of plates having a plurality of supports formed thereon, the pair of plates forming an upper plate and a lower plate wherein the plurality of supports formed on the upper and lower plates are axially aligned when the upper plate is disposed directly above the lower plate;

a plurality of spring members having end coils and disposed between the upper and lower plates, the end coils of the spring members being axially aligned with the plurality of supports; and a mechanism for retaining the spring members between the upper and lower plates.

25. The shoe of claim 24 wherein at least one cylindrical chamber is formed in the sole member for receiving the spring assembly.

* * * * *